US005309871A

United States Patent [19]

Kadlicko

[11] Patent Number: 5,309,871

[45] Date of Patent: May 10, 1994

[54] ROTATING EXHAUST VALVE

[75] Inventor: George Kadlicko, Mississauga, Canada

[73] Assignee: 814405 Ontario Ltd., Canada

[21] Appl. No.: 974,951

[22] Filed: Nov. 12, 1992

[51] Int. Cl.[5] ..... F01L 7/12

[52] U.S. Cl. ..... 123/80 BB; 123/58 B; 123/190.2

[58] Field of Search ..... 123/58 B, 58 BA, 80 BB, 123/190.2, 190.5

[56] References Cited

U.S. PATENT DOCUMENTS

| | | | |
|---|---|---|---|
| 1,096,544 | 2/1914 | Krayer | 123/190.5 |
| 1,286,149 | 11/1918 | Tips | 123/190.5 |
| 1,750,733 | 3/1930 | Stuart | 123/190.5 |
| 3,945,359 | 3/1976 | Asaga | 123/190.5 |
| 4,195,612 | 4/1980 | Klave | 123/190.5 |
| 4,279,225 | 7/1981 | Kersten | 123/80 BB |
| 4,313,404 | 2/1982 | Kossel | 123/190.5 |

*Primary Examiner*—E. Rollins Cross
*Assistant Examiner*—Erick Solis
*Attorney, Agent, or Firm*—Ladas & Parry

[57] ABSTRACT

An exhaust for an internal combustion engine includes an exhaust valve rotating within the cylinder block to communicate with successive cylinders. An exhaust conduit rotates with the valve and is of smaller diameter than the valve. Combustion products are initially exhausted thorugh the conduit to attain high velocity. Continued rotation of the valve closes the duct and directs combustion products through the valve. The conduit terminates within the valve to induce flow of gas through the valve.

14 Claims, 4 Drawing Sheets

ROTATING EXHAUST VALVE

The present invention relates to internal combustion engines and in particular to exhaust valves for use with such engines.

The efficient operation on an internal combustion engine depends upon its ability to purge the spent combustion products within the cylinder and replace them with combustion air. If the exhausting of combustion products is not performed effectively, loss of power, incomplete combustion and increased pollution may occur. The induction and expulsion of combustion gases is more readily accomplished in a four cycle engine where separate induction and expulsion strokes are included. However, in two cycle engines, it is necessary to expel combustion products as the combustion air is induced as alternate strokes of the piston are compression strokes.

Induction and expulsion of exhaust gases is frequently controlled through a valve mechanism provided in the cylinder head of the engine. With typical multicylinder engines, the valving arrangements are relatively complicated and utilize a large number of components. With two cycle engines, the induction and expulsion is usually performed through ports in the cylinder walls that are uncovered by the piston as the piston approaches bottom dead center. This arrangement avoids the need for valve trains and as such is a very efficient valving arrangement.

Nevertheless, in order to isolate cylinders from one another it is usual to provide separate exhaust ducts for each cylinder. This leads to an added complication in casting the cylinder block and a generally undesirable increase in the dead space within the exhaust system. Where an exhaust driven compressor is utilized to provide the combustion air and increase the power output from the engine it is necessary to control flow through the exhaust system with a valve so that the cylinder may be pressurized before the intake is closed. This further complicates the exhaust arrangement, particularly on two cycle engines where the intake and exhaust ducts are opened by piston.

In U.S. Pat. No. 4,497,284 to Schram, there is disclosed a multi-cylinder engine in which the cylinders are arranged around an exhaust valve. Proper phasing of the exhaust valve is provided by rotating the exhaust valve so it is aligned with the exhaust ports as they are opened by the movement of the piston. The arrangement shown in the patent of Schram provides a constant length exhaust duct for the engine and valves each of the cylinders but relies upon the expansion of the gases within the cylinder to effect expulsion and scavenging of the cylinder.

It is an object of the present invention to provide a engine in which the scavenging of the cylinder may be improved.

In general terms the present invention provides an exhaust valve for a reciprocating piston engine in which an exhaust duct communicates with exhaust ports in the cylinders. An exhaust conduit is located within the duct and rotates between the exhaust ports. The exhaust conduit is of smaller diameter than the duct so that the velocity of gases within the conduit is higher. The conduit terminates within the duct so that the flow of gases out of the conduit at relatively high velocity induces flow of gases through the duct. In this manner scavenging of the cylinder is more effective.

It is preferred that the cylinders in the exhaust valve are arranged such that the conduit is connected in advance to one of the exhaust ports while the duct is still in communication with a preceding cylinder. In this way, the initial flow of exhaust charge from the cylinder is at a high velocity through the conduit and induces the extraction of combustion products from the previously fired cylinder at a time when its volume is a maximum.

An embodiment of the invention will now be described by way of example only with reference to the accompanying drawings in which.

Figure 1:
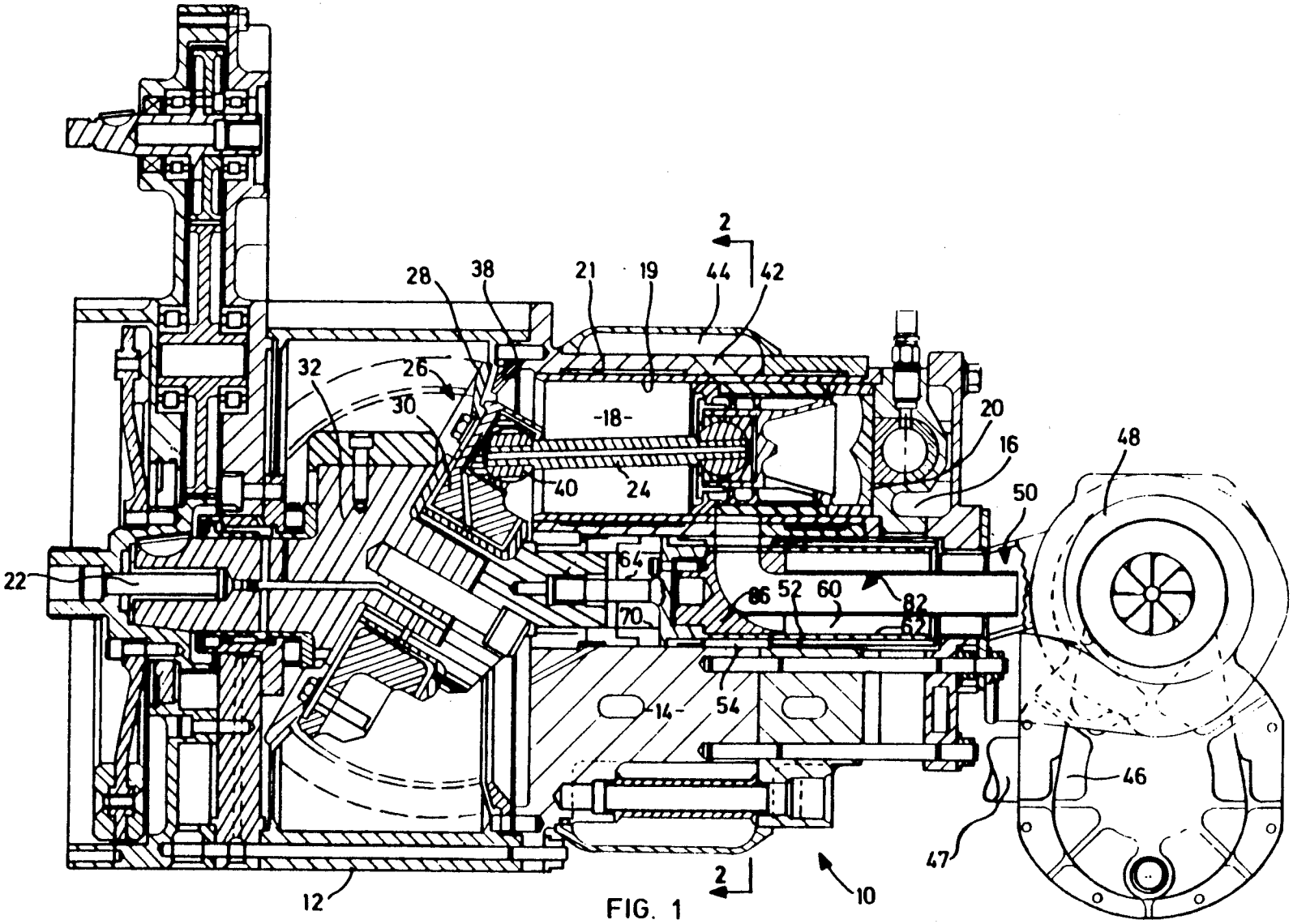
FIG. 1 is a sectional view through a reciprocating piston internal combustion engine.

Referring therefor to FIG. 1, an engine generally indicated 10 includes a crank case 12, a cylinder block 14 and a cylinder head 16. The engine 10 includes a number of cylinders 18 formed by liners 19 located in bores 21 of the cylinder block 14, each of which contains a piston 20. The cylinders 18 are parallel to one another and are uniformly distributed about a longitudinal axis indicated at 22. Each of the cylinders 18 includes a piston 20 connected through a connecting rod 24 to a crankshaft assembly 26. The crankshaft assembly 26 includes a nutating gear 28 rotatably mounted on bearings 30 to a crankshaft 32 for movement about an inclined axis. The crankshaft 32 is rotatably supported on bearings 34,36 for rotation about the longitudinal axis 22.

The nutating gear 28 engages with a stationary gear 38 secured to the crank case 12 and the connecting rods 24 are in turn secured through ball joints 40 to the nutating gear 28. An axial force from the piston 20 through the connecting rod 24 will tend to move the nutating gear 28 axially which, because of its inclination will induce rotation through the bearings 30 of the crankshaft 32 about the longitudinal axis. This motion, known as a wobble drive or nutating drive, is well known and will not be described further at this time.

Each of the cylinders 18 includes an inlet port to receive combustion air from an intake manifold 44. The manifold 44 extends around the cylinder block 14 and receives air from an air compressor 46 through a conduit 47. The air compressor 46 is connected by a turbine 48 driven by exhaust gases delivered through an exhaust duct 50. The air compressor and turbine 46,48 may be of any conventional turbo charger form.

Figure 2:
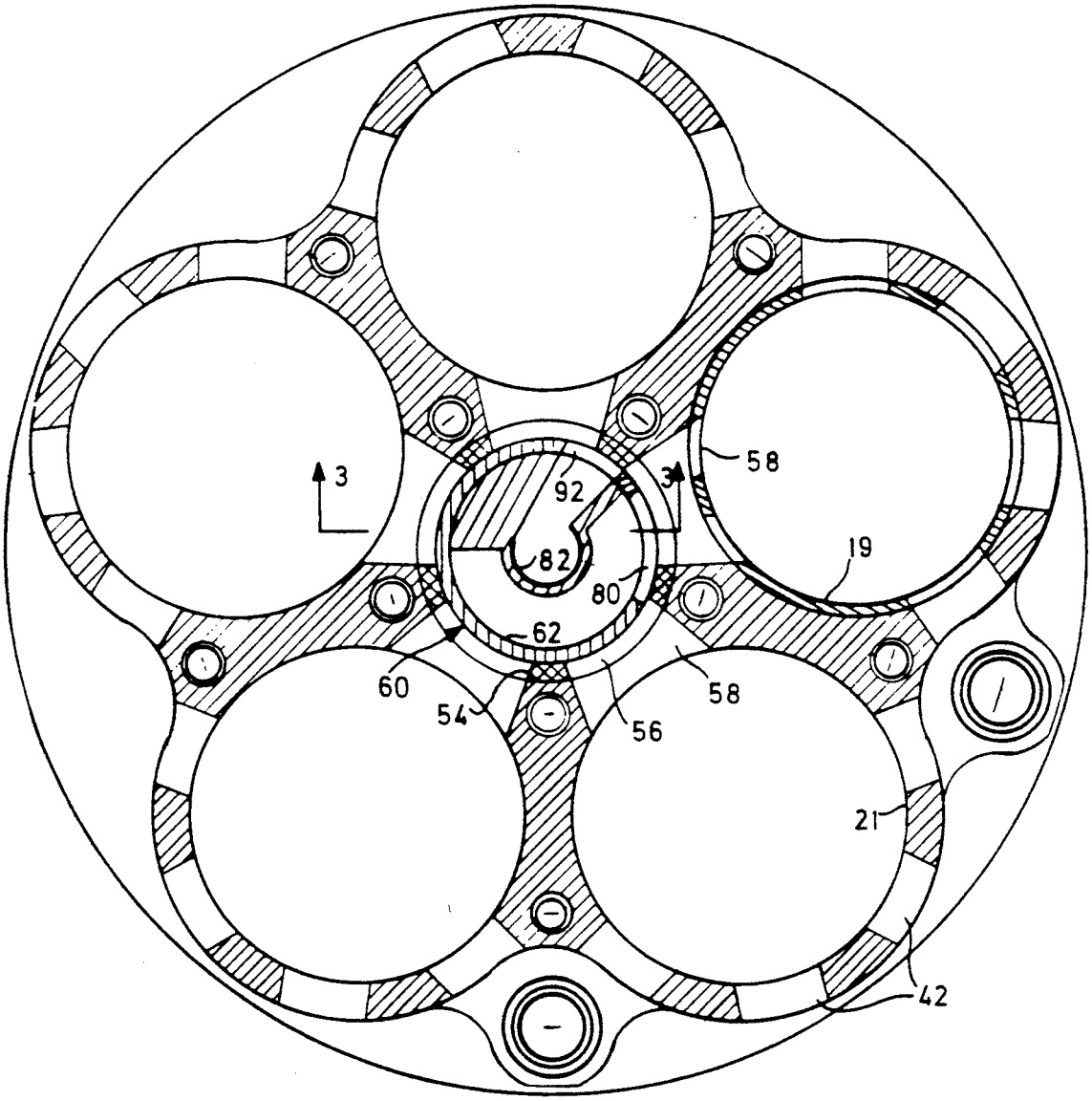
FIG. 2 is a view of the line II—II of FIG. 1.
Figure 3:
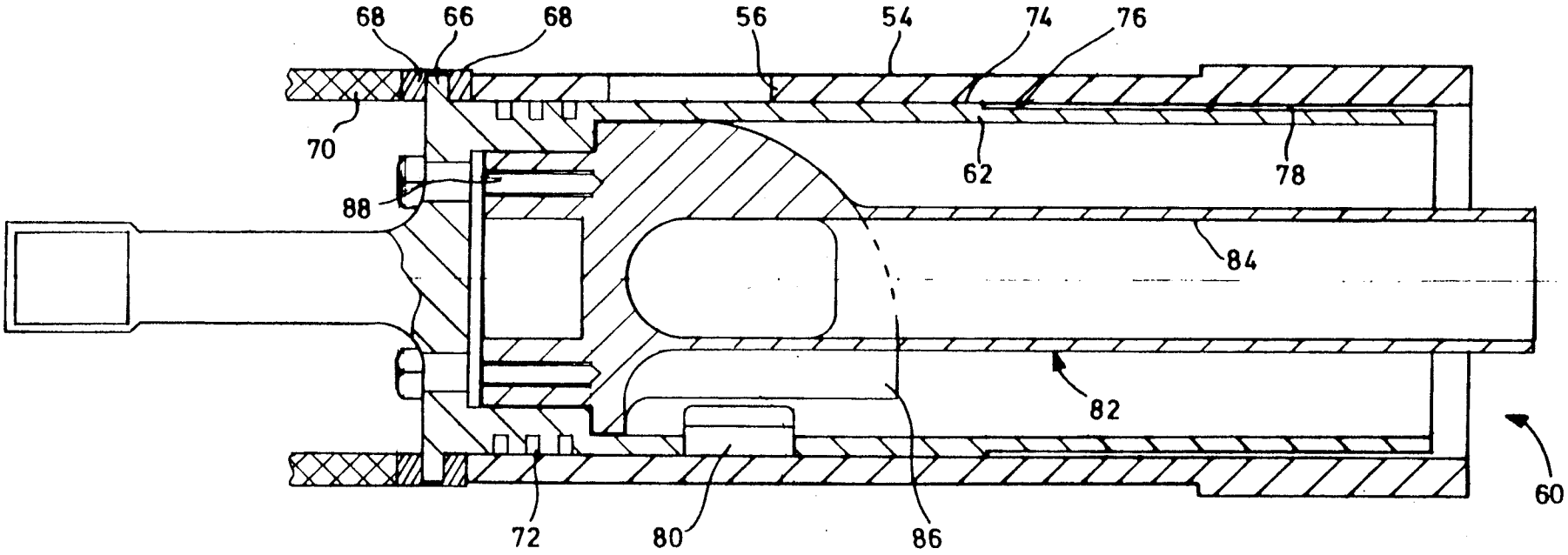
FIG. 3 is a view on an enlarged scale taken on the line: III—III of FIG. 2.

The exhaust duct 50 is formed in a central bore 52 of the cylinder block 14 disposed on the axis 22 and includes a stationary ported sleeve 54 as seen in FIG. 2. The sleeve 54 has apertures 56 aligned with exhaust ports 58 formed in the walls of the cylinder 18. A rotatable exhaust valve assembly 60 is located within the sleeve 54 and includes a rotatable sleeve 62 which is connected through a splined shaft 64 to the crankshaft 32. The rotatable sleeve 62 is axially located by means of a shoulder 66 (FIG. 3) received between a pair of graphite bearing rings 68 that are axially located between the end of stationary sleeve 54 and a spacer 70 that abuts the bearing 36. The rotatable sleeve 62 is sealed and supported relative to the stationary sleeve 54 by means of a graphite bearing sleeve 72.

The radially outer surface 74 of the rotatable sleeve 62 is stepped as indicated at 76 so that an annular space 78 is provided between the sleeve 62,72. A relatively large clearance is also provided between the stationary and rotating sleeves 54,62 which is sealed by graphite sleeves 68,72. This annular clearance accomodates thermal expansion of the rotating sleeve and inhibits heat transfer to the stationary sleeve 54 form the exhaust: gases.

As can best be seen in FIG. 2, the rotatable sleeve 62 includes an exhaust port 80 which aligns with successive apertures 56 as the sleeve 62 rotates. The exhaust port 80 allows exhaust products to flow from the cylinder 18 into the interior of the rotatable sleeve 62 and through to the exhaust duct 48.

Figure 5:
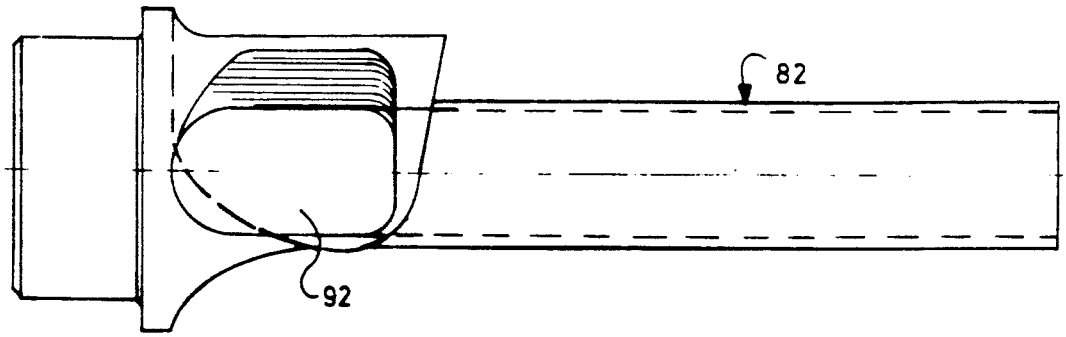
FIG. 5 is a view taken on the line V—V of FIG. 4.
Figure 6:
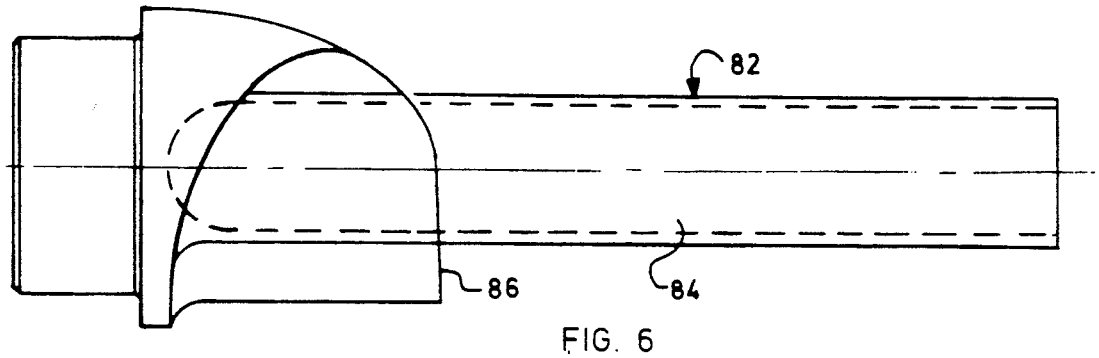
FIG. 6 is a view taken on the line VI—VI of FIG. 4.
Figure 4:
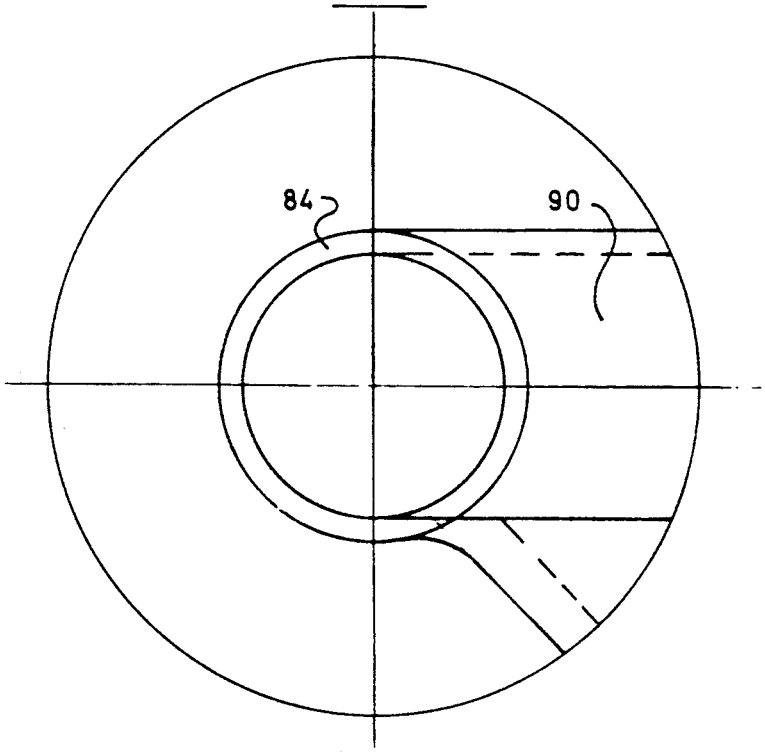
FIG. 4 is an end view of the valve shown in FIG. 3.

An exhaust conduit 82 is located within the rotatable sleeve 62 and is rotatable with the sleeve. The exhaust conduit 82 includes an axially extending pipe 84 which terminates in a boss 86. The boss is secured to the rotatable sleeve 62 by bolts 88 so that it is axially located and rotates with the sleeve 62. As can best be seen in FIGS. 3 and 4, the boss 86 provides a radial passageway 90 extending to the sleeve 62. The radial passageway 90 is aligned with an aperture 92 in the sleeve 62 that is successively aligned with the apertures 56 as the valve assembly rotates. Exhaust products from the cylinder 18 may thus flow through the aperture 92, the radial passageway 90 and into the interior of the pipe 84. The pipe 84 terminates within the duct 48 adjacent to the impeller ring of the turbine 48. As shown in FIGS. 5 and 6, the radial surface of the boss 86 is ranged in the direction of rotation to provide a smooth transition in flow direction for gases entering the sleeve 62.

In operation, the engine 10 operates on a two stroke compression ignition principle with fuel supplied from a fuel injection nozzle 96. Upon ignition of the charge products within one of the cylinders indicated 18*a*, the piston 20 is forced along the cylinder 18 to impart rotation to the crankshaft 32. At this time, the sleeve 62 is positioned to close off flow between the exhaust port and sleeve. As the piston 20 travels down the cylinder 18, the inlet ports 42 and exhaust ports 58 are progressively uncovered by the piston. At the same time, the exhaust valve assembly 60 is rotating with the crankshaft 32 and the aperture 92 is brought into alignment with the apertures 56 associated with that cylinder 18.

As the exhaust port 58 is uncovered, relatively high velocity exhaust gases flow through the aperture 92 into the exhaust conduit 82. It will be noted from FIG. 2 that at the time that the aperture 92 is aligned with the exhaust ports 58 of one cylinder, the aperture 80 in the rotatable sleeve 62 is in alignment with the exhaust ports 58 of the preceding adjacent cylinder indicated 18*b*. This cylinder 18*b* will have been fired immediately prior to the cylinder 18*a* so that its piston will be approaching bottom dead center and commencing the compression stroke due to the rotation of the crankshaft 32. Exhaust products in the preceding cylinder 18*b* are thus still able to flow through the respective aperture 56 into the rotatable sleeve 62 through the aperture 80 and discharged into the exhaust duct 48.

The exhaust products carried by the exhaust conduit 82 are relatively high velocity high temperature and are contained within the exhaust conduit 82 which has a smaller diameter than that of the sleeve 62. The exhaust products in the sleeve 62 are relatively lower velocity higher mass flow and lower temperature due to the purging of the cylinder 18 by the incoming combustion air from the intake port 42. The ejection of the high velocity gas stream from the pipe 82 within duct 48 acts as an induction pump to induce flow of exhaust products within the sleeve 62 and therefore extract the exhaust products from the cylinder 18. It will be appreciated that because of the spacing between the aperture 92 and the exhaust port 80, the high velocity gas flow from the cylinder 18*a* is available to induce scavenging flow from the previous cylinder 18*b*.

As the sleeve 62 continues to rotate, the aperture 80 in the sleeve 62 is brought into alignment with the exhaust ports 58 in cylinder 18*a* and flow through the aperture 92 from cylinder 18*a* prevented by the stationary sleeve 54.

Continued rotation of the crankshaft 32 moves the rotatable sleeve 62 so that the exhaust port 58 to the cylinder is closed by the sleeve 62 as the piston 20 commences its stroke towards the cylinder head 16. The closing of the exhaust port 58 by sleeve 62 is timed just prior to the closing of the inlet and exhaust ports in the cylinder 18 by movement of the piston 20 so that a charge from the air compressor 46 at elevated pressure may be contained within the cylinder 18.

In operation therefore, the exhaust valve assembly is in communication with a pair of adjacent cylinders 18 with the high velocity flow from one inducing a scavenging effect in the other. At the same time, the rotatable sleeve 62 closes the exhaust ports 58 of the other cylinders 18 during the compression and ignition portions of their strokes.

The heat transfer from the exhaust gases to the block 14 is mitigated by the annulus formed between the rotatable sleeve 62 and the stationary sleeve 54. Similarly the location of the conduit 82 centrally within the sleeve 62 inhibits heat transfer directly into the walls of the cylinder block and such heat transfer as occurs preheats the lower velocity flow within the sleeve 62 to improve the scavenging.

The arrangement of the centrally located exhaust duct 50 also benefits the operation of the turbine 48 by minimizing the length of the exhaust duct for each cylinder and thereby providing the maximum thermal energy to the turbine 48. The intake manifold 44 is likewise conveniently located to receive the output of compressor 46 through the conduit 47 thereby minimizing pressure losses.

We claim:

1. A reciprocating piston internal combustion engine having a plurality of pistons each in respective cylinders disposed about an exhaust valve assembly, said valve assembly including an exhaust duct communicating through respective exhaust ports with said cylinders and an exhaust conduit located within said duct and rotatable relative to said cylinders, said conduit having a conduit inlet alignable with successive ones of said exhaust ports as said conduit rotates to allow communication therewith and a conduit outlet located within said duct, said conduit having a lesser cross sectional area than said duct whereby the velocity of exhaust gas in said conduit is higher than in said duct and, upon ejection from said conduit outlet, while said conduit is in communication with an advanced cylinder, induces flow through said duct from a preceding cylinder communicating with said duct.

2. An engine according to claim 1 wherein said duct comprises a sleeve rotatable relative to said cylinders and having an inlet port alignable with successive ones of said exhaust ports as said sleeve rotates to allow communication between said cylinders and said sleeve.

3. An engine according to claim 2 wherein said conduit is located in said sleeve and spaced therefrom to inhibit heat transfer from exhaust gas in said conduit to said sleeve.

4. An engine according to claim 3 wherein said conduit is concentric with the axis of rotation of said sleeve.

5. An engine according to claim 3 wherein said sleeve is rotatable within a bore formed in a cylinder block containing said cylinders and said exhaust ports extend through said block from said bore to respective cylinders.

6. An engine according to claim 5 wherein a portion of an outer wall of said sleeve is spaced from said bore to inhibit heat transfer from said duct to said block.

7. An engine according to claim 5 wherein said exhaust ports communicate with respective cylinders in a region traversed by said piston during reciprocation in said cylinder.

8. An engine according to claim 7 wherein said piston progressively covers a respective one of said exhaust port as it moves from a position in which the volume of respective cylinder is maximum to a position in which said volume is a minimum.

9. An engine according to claim 8 wherein said pistons reciprocate in cylinders along an axis substantially parallel to the axis of rotation of said sleeve.

10. An engine according to claim 9 wherein each cylinder includes a combustion air inlet port communicating with cylinder at a location opposite to said exhaust port.

11. An engine according to claim 10 wherein a manifold extends between said inlet ports and about said cylinder block to convey combustion air from an air compressor to said air inlet ports.

12. An engine according to claim 9 wherein reciprocation of said pistons is converted into rotary motion of an output shaft by an inclined rotatable plate.

13. An engine according to claim 11 wherein said compressor is driven by exhaust gas delivered through said exhaust duct.

14. An engine according to claim 13 wherein said compressor is driven by an exhaust driven turbine having an impeller and said conduit terminates adjacent to said impeller.

* * * * *